US009995058B2

(12) United States Patent
Jin

(10) Patent No.: US 9,995,058 B2
(45) Date of Patent: Jun. 12, 2018

(54) AUTOMATICALLY FOLDABLE TENT FRAMES AND MECHANISMS FOR AUTOMATICALLY FOLDING AND UNFOLDING TENT FRAMES

(71) Applicant: Xiamen Innovation Metal Products Co., Ltd., Xiamen (CN)

(72) Inventor: Juyoung Jin, Xiamen (CN)

(73) Assignee: Xiamen Innovation Metal Products Co., LTD., Xiamen (CN)

( * ) Notice: Subject to any disclaimer, the term of this patent is extended or adjusted under 35 U.S.C. 154(b) by 0 days. days.

(21) Appl. No.: 15/170,587

(22) Filed: Jun. 1, 2016

(65) Prior Publication Data

US 2016/0348392 A1 Dec. 1, 2016

(30) Foreign Application Priority Data

Jun. 1, 2015 (CN) ..... 2015 1 0291068
Jun. 1, 2015 (CN) ..... 2015 2 0365298 U

(51) Int. Cl.
*E04H 15/50* (2006.01)
*G08C 17/02* (2006.01)
(Continued)

(52) U.S. Cl.
CPC ..... *E04H 15/50* (2013.01); *E04H 15/46* (2013.01); *E04H 15/48* (2013.01); *E04H 15/62* (2013.01); *G08C 17/02* (2013.01)

(58) Field of Classification Search
CPC ..... E04H 15/50; E04H 15/46; E04H 15/48; E04H 15/32
See application file for complete search history.

(56) References Cited

U.S. PATENT DOCUMENTS 1,061,547 A 5/1913 Kennedy
1,347,107 A 7/1920 McCann
(Continued)

FOREIGN PATENT DOCUMENTS

CN 2401649 Y 10/2000
CN 201202302 Y 3/2009
(Continued)

OTHER PUBLICATIONS

U.S. Appl. No. 14/762,139, filed Dec. 16, 2015.
(Continued)

*Primary Examiner* — Noah Chandler Hawk
(74) *Attorney, Agent, or Firm* — Morgan, Lewis & Bockius LLP

(57) ABSTRACT

A tent frame includes supporting poles and an upper frame connected to the supporting poles. The upper frame includes a guide pole, first and second connectors, upper connecting units, and a driving mechanism. The first and second connectors are coupled with the guide pole. Each upper connecting unit includes one or more upper pole pairs. Each upper pole pair includes two upper poles pivotally connected to each other and forming an "X" shape when unfolded. Of the upper pole pair proximal the guide pole, one upper pole is pivotally connected to the first connector and the other upper pole is pivotally connected to the second connector. The driving mechanism includes a motor for moving one or both of the first and second connectors along the guide pole, a power source for providing power to the motor, and a controlling device for controlling the motor.

12 Claims, 12 Drawing Sheets

(51) Int. Cl.

| | |
|---|---|
| ***E04H 15/48*** | (2006.01) |
| ***E04H 15/46*** | (2006.01) |
| ***E04H 15/62*** | (2006.01) |

(56) References Cited

U.S. PATENT DOCUMENTS

| | | | | |
|---|---|---|---|---|
| 3,888,056 | A * | 6/1975 | Kelly | E04L 31/32 135/145 |
| 4,944,321 | A | 7/1990 | Moyet-Ortiz | |
| 5,275,188 | A | 1/1994 | Tsai | |
| 5,794,640 | A * | 8/1998 | Jang | E04H 15/50 135/131 |
| 5,813,425 | A | 9/1998 | Carter | |
| 6,182,917 | B1 * | 2/2001 | Lai | A45B 25/14 135/20.3 |
| 6,463,948 | B2 | 10/2002 | Lee | |
| 6,598,614 | B2 * | 7/2003 | Liu | E04H 15/50 135/131 |
| 6,708,707 | B2 * | 3/2004 | Dotterweich | E04H 15/50 135/131 |
| 6,848,461 | B2 | 2/2005 | Tsai | |
| 6,929,017 | B2 * | 8/2005 | Byun | E04H 15/50 135/131 |
| 7,240,686 | B2 * | 7/2007 | Seo | E04H 15/50 135/131 |
| 7,299,813 | B2 | 11/2007 | Ochi | |
| 7,316,239 | B2 | 1/2008 | Yang | |
| 7,360,549 | B2 * | 4/2008 | Seo | E04H 15/44 135/145 |
| 7,422,026 | B2 * | 9/2008 | Kim | E04H 15/50 135/120.2 |
| 8,220,477 | B2 * | 7/2012 | Park | E04H 15/50 135/131 |
| D705,884 | S | 5/2014 | Jin | |
| 8,893,737 | B2 | 11/2014 | Yang | |
| 8,910,648 | B2 | 12/2014 | Jin | |
| 9,528,292 | B1 | 12/2016 | Lovely, II | |
| 9,739,073 | B2 | 8/2017 | Huang | |
| 2001/0050098 | A1 | 12/2001 | Lee | |
| 2002/0074032 | A1 * | 6/2002 | Park | E04H 15/50 135/131 |
| 2005/0241688 | A1 | 11/2005 | Wu | |
| 2006/0169312 | A1 | 8/2006 | Choi | |
| 2007/0012347 | A1 | 1/2007 | Ochi | |
| 2007/0051397 | A1 | 3/2007 | Choi | |
| 2007/0144572 | A1 | 6/2007 | Patel | |
| 2009/0032079 | A1 | 2/2009 | Choi | |
| 2011/0073148 | A1 | 3/2011 | Choi | |
| 2013/0014794 | A1 | 1/2013 | Jin | |
| 2013/0247948 | A1 | 9/2013 | Lovely et al. | |
| 2013/0284225 | A1 | 10/2013 | Holland | |
| 2014/0261601 | A1 | 9/2014 | Jin | |
| 2014/0290710 | A1 | 10/2014 | Choi | |
| 2015/0083177 | A1 | 3/2015 | Hotes | |
| 2015/0247339 | A1 | 9/2015 | Lee | |
| 2015/0308147 | A1 | 10/2015 | Lee | |
| 2015/0376913 | A1 * | 12/2015 | Choi | E04H 15/50 135/147 |
| 2016/0108639 | A1 | 4/2016 | Huang | |
| 2016/0348392 | A1 | 12/2016 | Jin | |
| 2017/0121999 | A1 | 5/2017 | Ma | |
| 2017/0292287 | A1 | 10/2017 | Lovely, II | |

FOREIGN PATENT DOCUMENTS

| | | | |
|---|---|---|---|
| CN | 103590650 | B | 2/2014 |
| CN | 104265063 | A | 1/2015 |
| CN | 104358468 | A | 2/2015 |
| CN | 204163467 | U | 2/2015 |
| FR | 1 121 851 | | 8/1956 |
| FR | 68588 | | 5/1958 |
| JP | 4557885 | B2 | 10/2010 |
| WO | WO 2010/104939 | A1 | 9/2010 |
| WO | WO 2011/022764 | A1 | 3/2011 |
| WO | WO 2013/116545 | A1 | 8/2013 |

OTHER PUBLICATIONS

U.S. Appl. No. 14/221,087, filed Mar. 20, 2014.
U.S. Appl. No. 14/225,776, filed Mar. 26, 2014.
U.S. Appl. No. 14/280,845, filed May 19, 2014.
U.S. Appl. No. 14/292,024, filed May 30, 2014.
U.S. Appl. No. 15/080,316, filed Mar. 24, 2016.
U.S. Appl. No. 14/910,979, filed Jun. 28, 2016.
U.S. Appl. No. 14/998,549, filed Dec. 24, 2015.
U.S. Appl. No. 15/217,835, filed Jul. 22, 2016.
U.S. Appl. No. 15/056,150, filed Feb. 29, 2016.
U.S. Appl. No. 15/144,575, filed May 2, 2016.
U.S. Appl. No. 14/753,989, filed Jun. 29, 2015.
U.S. Appl. No. 29/600,927, filed Apr. 17, 2017.
U.S. Appl. No. 29/600,929, filed Apr. 17, 2017.
U.S. Appl. No. 15/709,222, filed Sep. 19, 2017.
U.S. Appl. No. 15/709,234, filed Sep. 19, 2017.
U.S. Appl. No. 15/782,699, filed Oct. 12, 2017.
U.S. Appl. No. 15/782,717, filed Oct. 12, 2017.
U.S. Appl. No. 15/782,726, filed Oct. 12, 2017.
U.S. Appl. No. 15/821,019, filed Nov. 22, 2017.
U.S. Appl. No. 15/170,566, filed Jun. 1, 2016.

* cited by examiner

AUTOMATICALLY FOLDABLE TENT FRAMES AND MECHANISMS FOR AUTOMATICALLY FOLDING AND UNFOLDING TENT FRAMES

CROSS-REFERENCE TO RELATED APPLICATIONS

The present application claims priority of Chinese Utility Model Applications CN 201510291068.4 filed on Jun. 1, 2015, and CN 201520365298.6 filed on Jun. 1, 2015, the entire contents of which application are incorporated herein for all purposes by this reference.

FIELD OF THE INVENTION

The present invention generally relates to tent frames and mechanisms for tent frames. More particularly, the present invention relates to automatically foldable tent frames and mechanisms for automatically folding and unfolding tent frames.

BACKGROUND

Existing tent frames are configured to be folded or unfolded manually, and folding and unfolding of the existing tent frames in general are quite tedious and time consuming. As such, existing tent frames are inconvenient to use.

Given the current state of the art, there remains a need for tent frames and mechanisms that address the abovementioned issues.

The information disclosed in this Background section is provided for an understanding of the general background of the invention and is not an acknowledgement or suggestion that this information forms part of the prior art already known to a person skilled in the art.

SUMMARY

Various embodiments of the present invention provide automatically foldable tent frames and mechanisms that facilitate automatic folding and unfolding of the tent frames.

In some embodiments, a tent frame of the present invention includes a plurality of supporting poles, and an upper frame connected to the plurality of supporting poles. The upper frame includes a guide pole, first and second connectors, a plurality of upper connecting units, and a driving mechanism. First and second connectors are coupled with the guide pole, with at least one of the first and second connectors movable along the guide pole. When the tent frame is unfolded, the first connector is above the second connector. Each upper connecting unit includes one or more upper pole pairs. Each upper pole pair includes two upper poles pivotally connected to each other and forming an "X" shape when unfolded. Of the upper pole pair proximal the guide pole, one upper pole is pivotally connected to the first connector and the other upper pole is pivotally connected to the second connector. The driving mechanism includes a motor for moving one or both of the first and second connectors along the guide pole, a power source for providing power to the motor, and a controlling device for controlling the motor.

In some embodiments, the upper frame further includes an auxiliary mechanism for assisting folding and unfolding of the tent frame. The auxiliary mechanism includes an auxiliary connector and a plurality of auxiliary poles. The auxiliary connector is movably disposed on the guide pole above the first connector. Each auxiliary pole has one end pivotally connected to the auxiliary connector and the other end pivotally connected to the other upper pole that is pivotally connected to the second connector. In some embodiments, the driving mechanism further includes a retractable pole having one end connected to the motor and the other end connected to the auxiliary connector.

In an embodiment, the guide pole is formed with a rail for guiding the movement of the first, second, or both connectors.

In some embodiments, the controlling device includes a remote control and a controller connected to the motor. The remote control includes an emitter, and the controller includes a receiver corresponding to the emitter. The controller or the controlling device is disposed at one of the supporting poles or at one of the poles of the upper frame.

In an embodiment, the second connector is fixedly coupled to a lower end of the guide pole, where driving mechanism moves the first connector along the guide pole upward to fold the tent frame and downward to unfold the tent frame. In another embodiment, both of the first and second connectors are movably coupled to the guide pole, where the driving mechanism moves the first and second connectors along the guide pole away from to fold the tent frame and towards each other to unfold the tent frame.

In some embodiments, each upper connecting unit includes two or three upper pole pairs, and ends of adjacent upper pole pairs in each upper connecting unit are pivotally connected to each other.

In some embodiments, the tent frame further includes a plurality of third connectors and a plurality of second connectors. Each third connector is movably coupled with a corresponding supporting pole, and each fourth connector is fixedly coupled with an upper end of a corresponding supporting pole. In some embodiments, of the upper pole pair proximal the corresponding supporting pole, one upper pole is pivotally connected to the third connector and the other upper pole is pivotally connected to the fourth connector.

In some embodiments, the upper frame further includes a plurality of side connecting units, each disposed between two adjacent supporting poles.

In an embodiment, each side connecting unit includes two or more side poles pivotally connected to each other at their proximal ends. Side poles at both ends of each side connecting unit are pivotally connected to the fourth connectors that are fixedly coupled with the two adjacent supporting poles. In an embodiment, the upper frame further includes a plurality of oblique poles. Each oblique pole is pivotally connected to the third connector at a corresponding supporting pole, and pivotally connected to the side pole that is connected to the fourth connector at the corresponding supporting pole.

In another embodiment, each side connecting unit includes one or more side pole pairs. Each side pole pair includes two side poles pivotally connected to each other and forming an "X" shape when unfolded. Adjacent side pole pairs are pivotally connected to each other at ends of corresponding side poles. Side poles at both ends of the side connecting unit are pivotally connected to the third and fourth connectors at adjacent supporting poles. In one embodiment, each side connecting unit includes four side pole pairs.

In some embodiment, the upper frame further includes one or more first side connecting units, and one or more second side connecting unit different than the one or more first side connecting units, where each of the first and second side connecting units is disposed between two adjacent supporting poles. In an embodiment, each of the one or more first side connecting units includes two or more side poles pivotally connected to each other, where side poles at both ends of each side connecting unit are pivotally connected to the fourth connectors that are fixedly coupled with the two adjacent supporting poles. In an embodiment, each of the one or more second side connecting units one or more side pole pairs, where each side pole pair includes two side poles pivotally connected to each other and forming an "X" shape when unfolded.

In some embodiment, each side connecting unit includes two side pole pairs. Each side pole pair includes first and second side poles pivotally connected to each other and forming an "X" shape when unfolded. Proximal ends of the first side poles of the two side pole pairs are pivotally connected to each other, defining an upper pivot point. Dismal ends of the first side poles of the two side pole pairs are pivotally connected to the third connectors at the two adjacent supporting poles. Proximal ends of the second side poles of the two side pole pairs are pivotally connected to each other, defining a lower pivot point. Dismal ends of the second side poles of the two side pole pairs are pivotally connected to the fourth connectors at the two adjacent supporting poles. For each upper connecting unit, one upper pole of the upper pole pair proximal a corresponding side connecting unit is pivotally connected to the corresponding side connecting unit at the upper pivot point, and the other upper pole of the upper pole pair proximal the corresponding side connecting unit is pivotally connected to the corresponding side connecting unit at the lower pivot point. In an embodiment, each upper connecting unit includes one upper pole pair having two upper poles, where one upper pole has one end pivotally connected to the first connector and another end pivotally connected to the corresponding side connecting unit at the lower pivot point, and the other upper pole has one end pivotally connected to the second connector and another end pivotally connected to the corresponding side connecting unit at the upper pivot point.

In some embodiments, the tent frame further includes a fixation base and a plurality of wheels. The fixation base is installed at a lower end of one supporting pole and each wheel is installed at a lower end of a remaining supporting pole.

The systems of the present invention have other features and advantages that will be apparent from or are set forth in more detail in the accompanying drawings, which are incorporated herein, and the following Detailed Description, which together serve to explain certain principles of exemplary embodiments of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
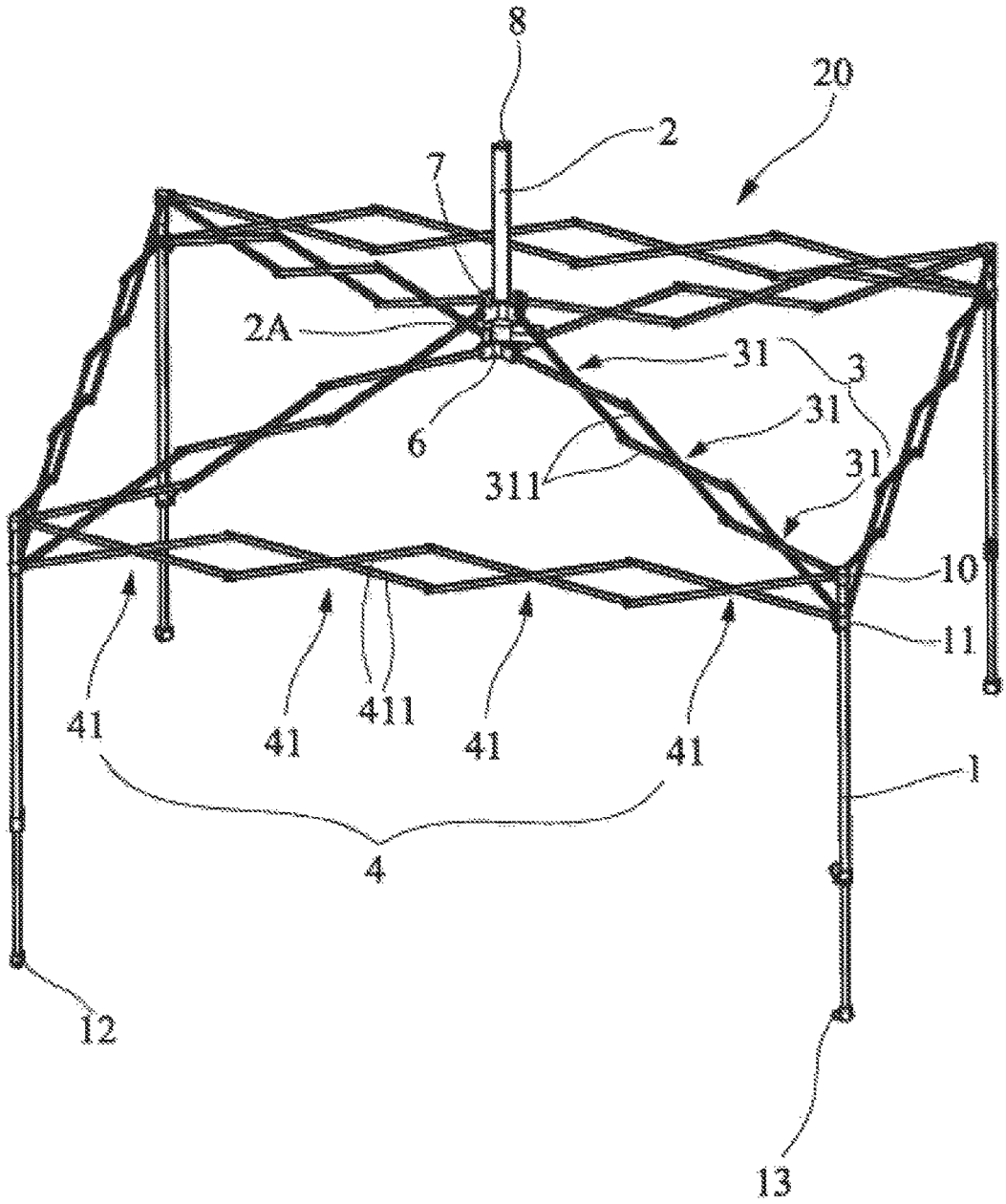
FIG. 1 is a schematic view illustrating a tent frame in an unfolded state in accordance with exemplary embodiments of the present invention.
Figure 2:
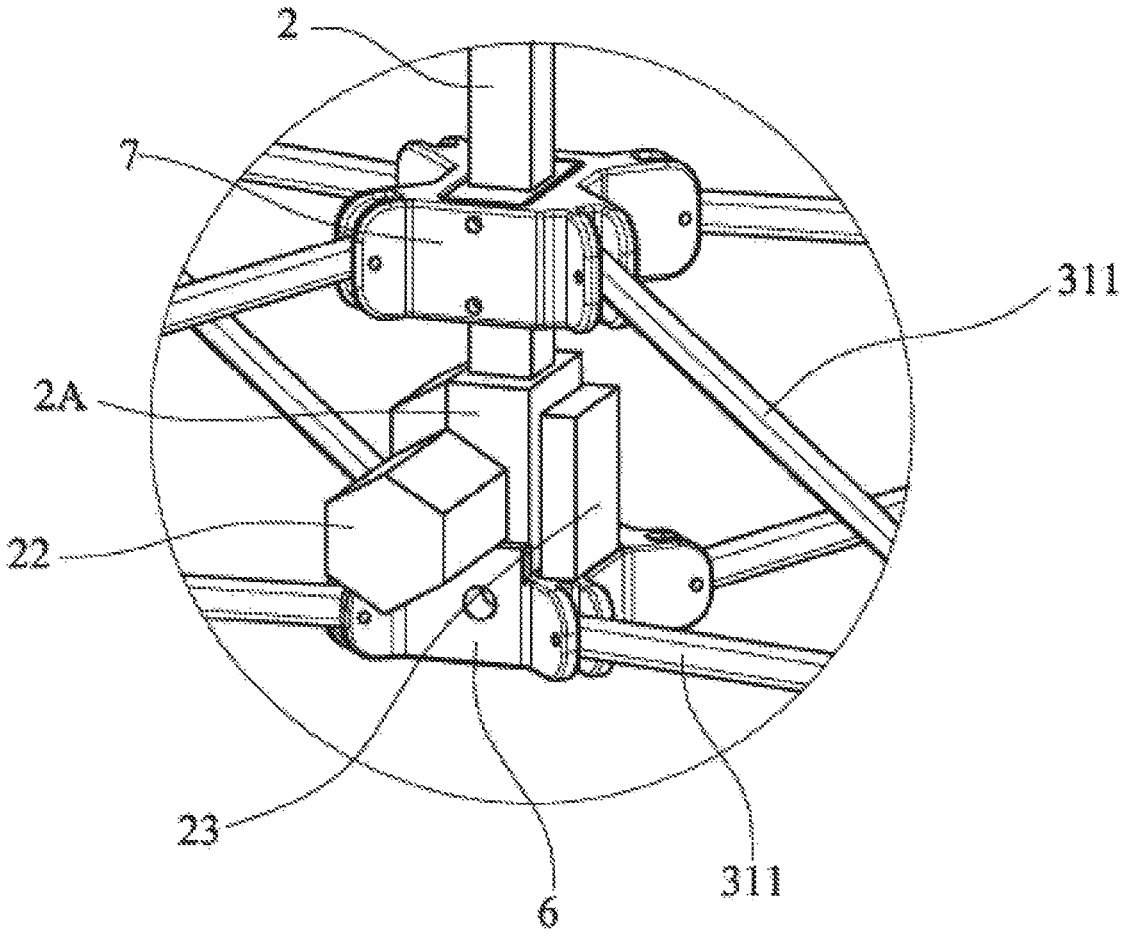
FIG. 2 is a partially enlarged view illustrating a driving mechanism of a tent frame in accordance with exemplary embodiments of the present invention.
Figure 3:
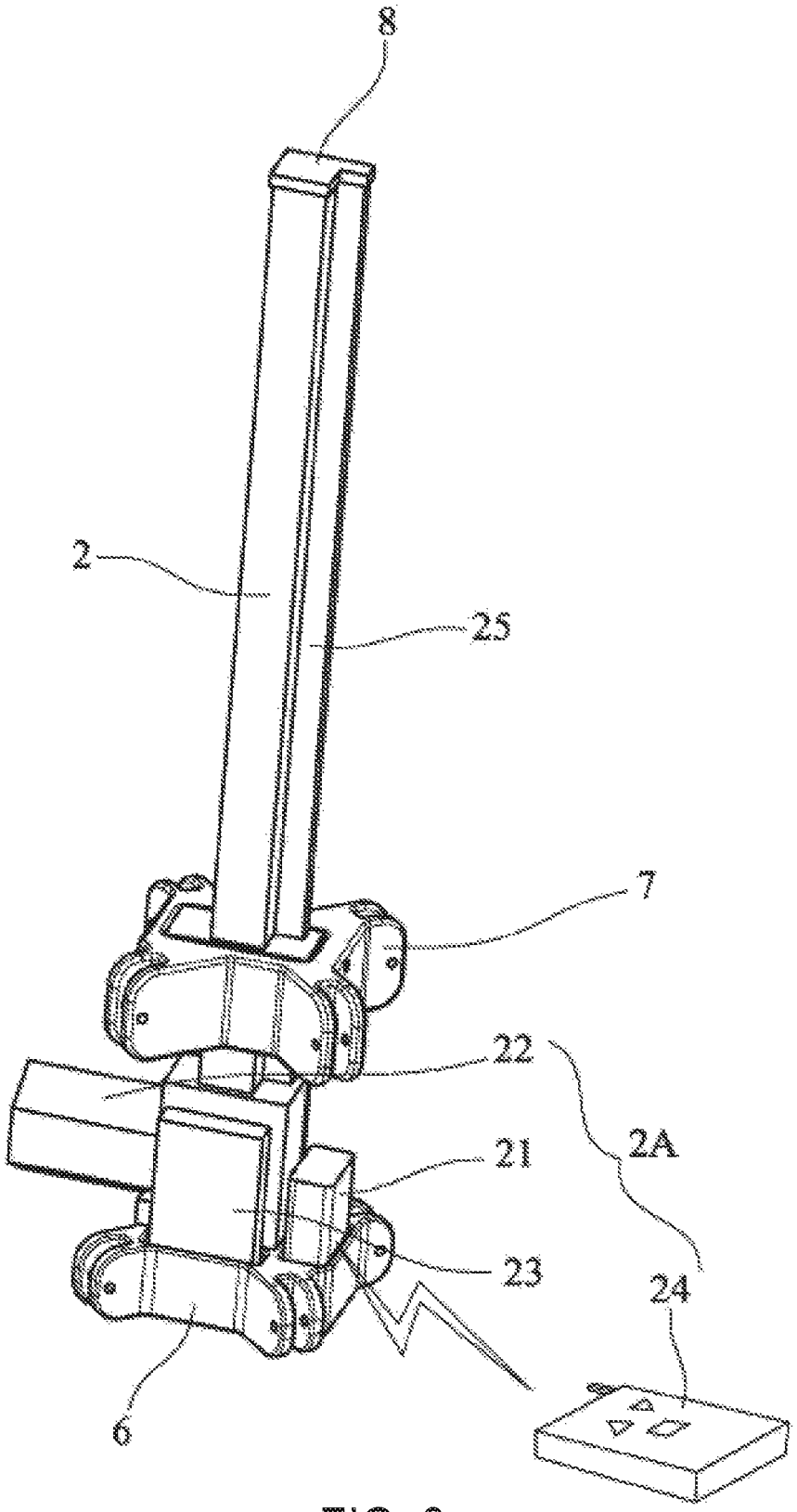
FIG. 3 is a partially enlarged view illustrating variations of a driving mechanism of a tent frame in accordance with exemplary embodiments of the present invention.

Reference will now be made in detail to implementations of the exemplary embodiments of the present invention as illustrated in the accompanying drawings. The same reference indicators will be used throughout the drawings and the following detailed description to refer to the same or like parts. Those of ordinary skill in the art will understand that the following detailed description is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of the embodiments set forth in this disclosure can be made without departing from their spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of automatically foldable tent frames, and mechanisms for automatically folding and unfolding tent frames. Generally, a tent frame of the present invention includes a plurality of supporting poles and an upper frame connected to the plurality of supporting poles. The upper frame includes a driving mechanism that facilitates automatic folding and unfolding of the tent frame. A tent frame of the present invention can be of various sizes and shapes. It can include various number of supporting poles such as three, four, five or more supporting poles and various number of connecting units such as three, four, five or more connecting units.

Referring to FIGS. 1-5, there depicts a tent frame in accordance with exemplary embodiments of the present invention. As shown, the tent frame includes a plurality of supporting poles such as supporting poles 1, and an upper frame such as upper frame 20. Upper frame 20 is connected to the plurality of supporting poles 1, generally, at the upper end of the supporting poles 1.

In some embodiments, corresponding to each supporting pole 1, the tent frame includes a third connector such as third connector 11 and a fourth connector such as fourth connector 10. Third connector 11 is movably coupled with the supporting pole, and fourth connector 10 is fixedly coupled with an upper end of a corresponding supporting pole.

In some embodiments, the tent frame of the present invention also includes a fixation base such as base 13 and a plurality of wheels 12. Fixation base 13 is installed at a lower end of one supporting pole, and each wheel 12 is installed at a lower end of a remaining supporting pole.

Upper frame 20 includes guide pole 2, first connector 7, second connector 6, driving mechanism 2A, and a plurality of upper connecting units such as four connecting units 3 illustrated in FIG. 1. First and second connectors are disposed at or coupled with the guide pole, with at least one of the first and second connectors movable along the guide pole. For example, in an embodiment, the first connector is slidably coupled to the guide pole and the second connector is fixedly coupled to the guide pole (e.g., at the lower end of the guide pole). In another embodiment, both of the first and second connectors are slidably coupled to the guide pole. When the tent frame is unfolded, first connector 7 is positioned above second connector 6.

In some embodiments, the tent frame of the present invention also includes a supporting member such as supporting member 8 coupled to or formed at the upper end of the guide pole. Supporting member 8 can be used for supporting a tent cloth.

Driving mechanism 2A in general includes a motor such as motor 22, a power source such as power source 23 (e.g., battery, fuel cell, solar cell), and a controlling device. The power source provides power to the motor, and the controlling device controls the operation or motion of the motor. In some embodiments, the controlling device includes a controller such as controller 21 operably connected to the motor and controls the operation of the motor. In an embodiment, the controller is disposed at the guide pole or any other pole of the tent frame. In an embodiment, the controlling device includes an on/off switch or controller 21 is an on/off switch. In some embodiments, the controlling device further includes a remote control such as remote control 24 having an emitter to send operational signals. In such embodiments, controller 21 includes a receiver, corresponding to the emitter, to receive the operational signals, and controls the motor accordingly. When operated, the motor moves one or both of the first and second connectors along the guide pole, thereby facilitating folding and unfolding of the tent frame. In some embodiments, the guide pole is formed with a rail such as rail 25 for guiding the movement of the first, second, or both connectors.

Figure 8:
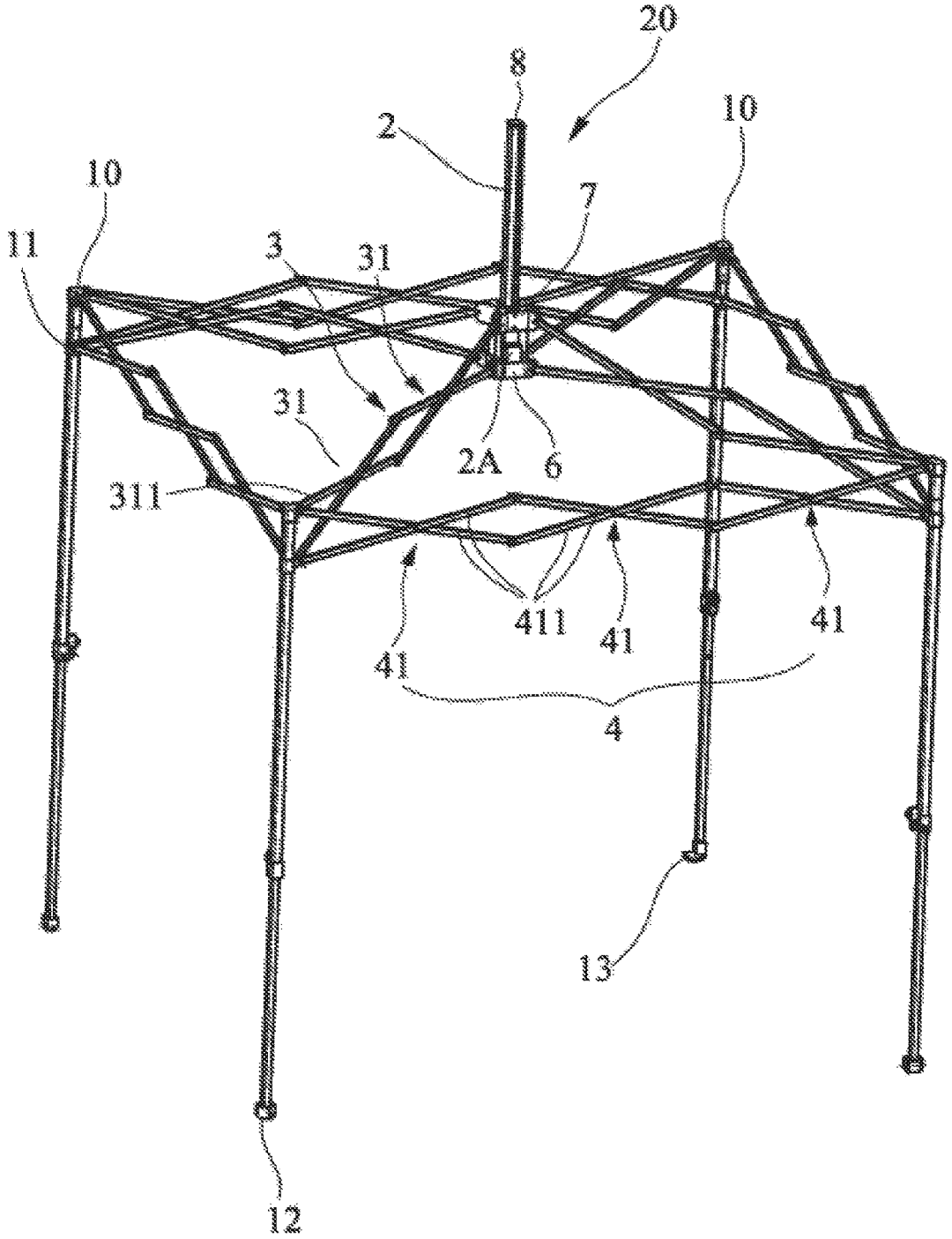
FIG. 8 is a schematic view illustrating a third exemplary variation of the tent frame of FIG. 1 in an unfolded state in accordance with exemplary embodiments of the present invention.
Figure 9:
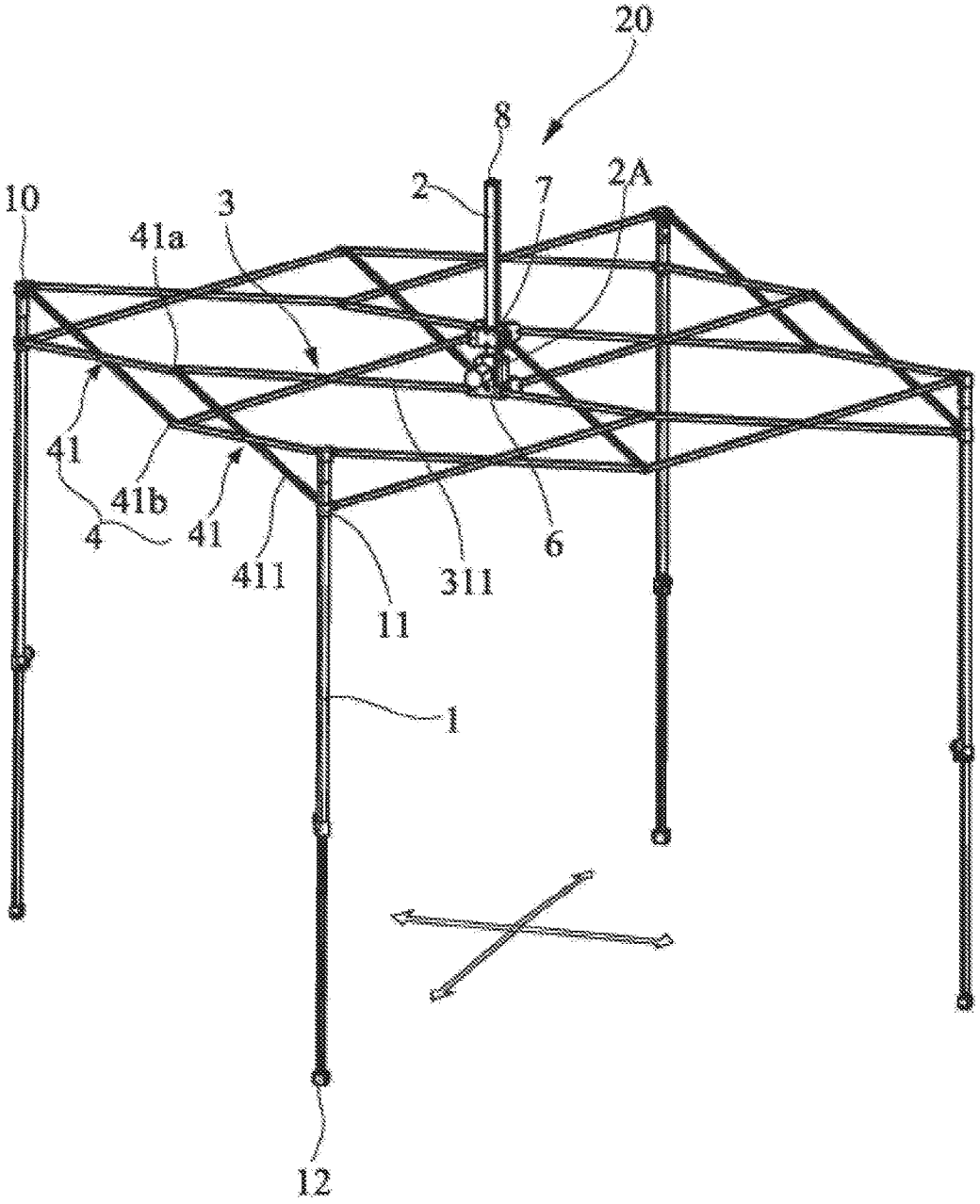
FIG. 9 is a schematic view illustrating a fourth exemplary variation of the tent frame of FIG. 1 in an unfolded state in accordance with exemplary embodiments of the present invention.

Each upper connecting unit includes one or more upper pole pairs such as three upper pole pairs 31 illustrated in FIG. 1. Each upper pole pair 31 includes two upper poles 311 pivotally connected to each other and forming an "X" shape when unfolded. Of the upper pole pair proximal guide pole 2, one upper pole is pivotally connected to first connector 7 and the other upper pole is pivotally connected to second connector 6. It should be noted that an upper connecting unit can includes any suitable number of upper pole pairs, and the number does not necessarily need to be the same for each upper connecting unit. For example, FIG. 8 illustrates an upper connecting unit with two upper pole pairs, and FIG. 9 illustrates an upper connecting unit with one upper pole pair.

In some embodiments, of the upper pole pair proximal a corresponding supporting pole, one upper pole is pivotally connected to the third connector at the corresponding supporting pole and the other upper pole is pivotally connected to the fourth connector corresponding supporting pole.

In some embodiments, upper frame 20 also includes a plurality of side connecting units such as side connecting units 4, each disposed between two adjacent supporting poles 1. By way of example, FIG. 1 illustrates four side connecting units 4, each made of four side pole pairs 41. Each side pole pair 41 includes two side poles 411 pivotally connected to each other and forming an "X" shape when unfolded. Adjacent side pole pairs are pivotally connected to each other at their corresponding ends. Of each side connecting unit 4, side poles 411 at both ends are pivotally connected to third connector 11 and fourth connector 10 at adjacent supporting poles.

Figure 10:
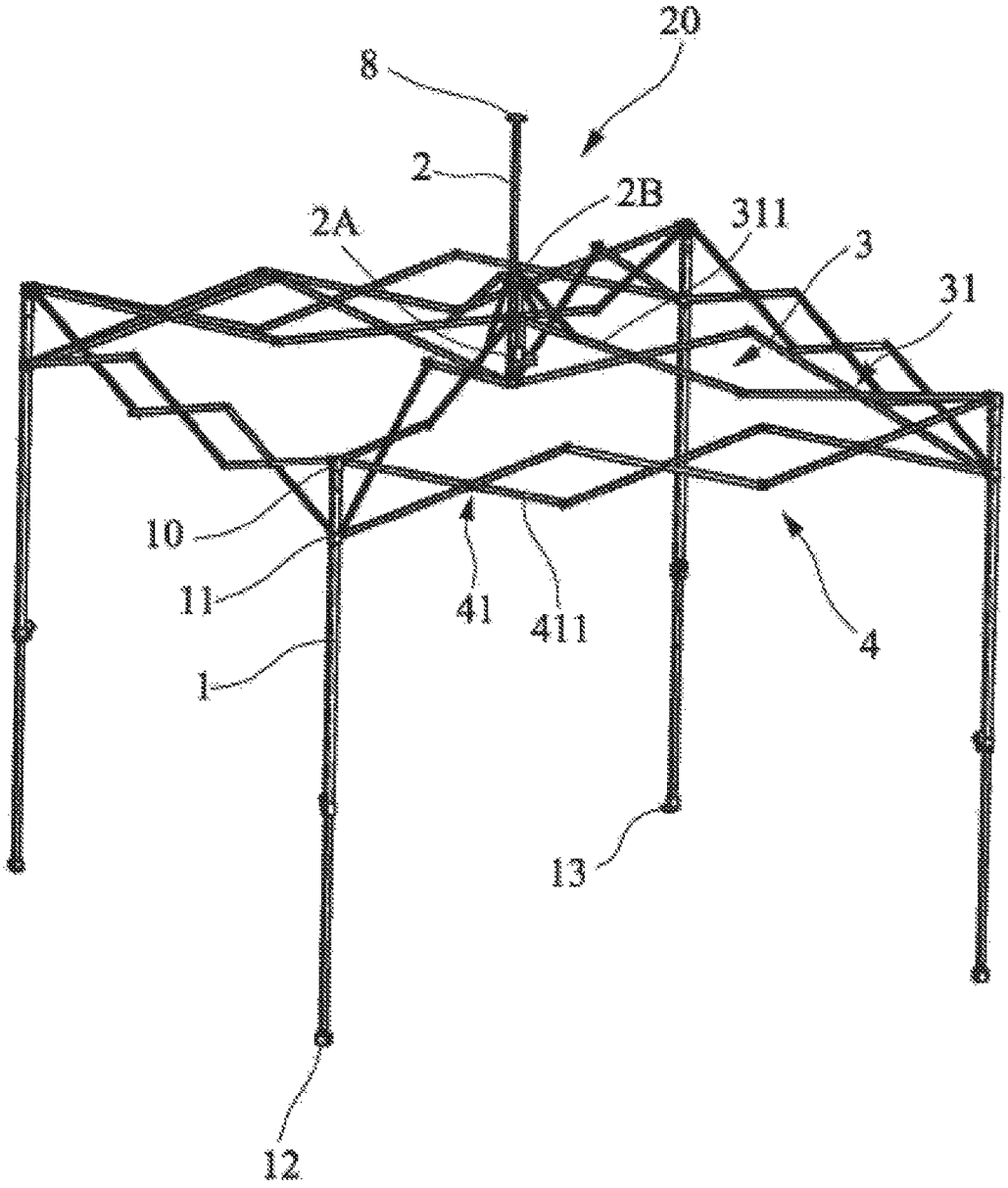
FIG. 10 is a schematic view illustrating a tent frame with an auxiliary mechanism in an unfolded state in accordance with exemplary embodiments of the present invention.

It should be noted that a side connecting unit can have any suitable number of side pole pairs such as one, two, three, or more side pole pairs. For example, FIGS. 9 and 10 illustrate side connecting unit 4 having two side pole pairs 41, and FIG. 8 illustrates side connecting unit 4 having three side pole pairs 41.

Figure 6:
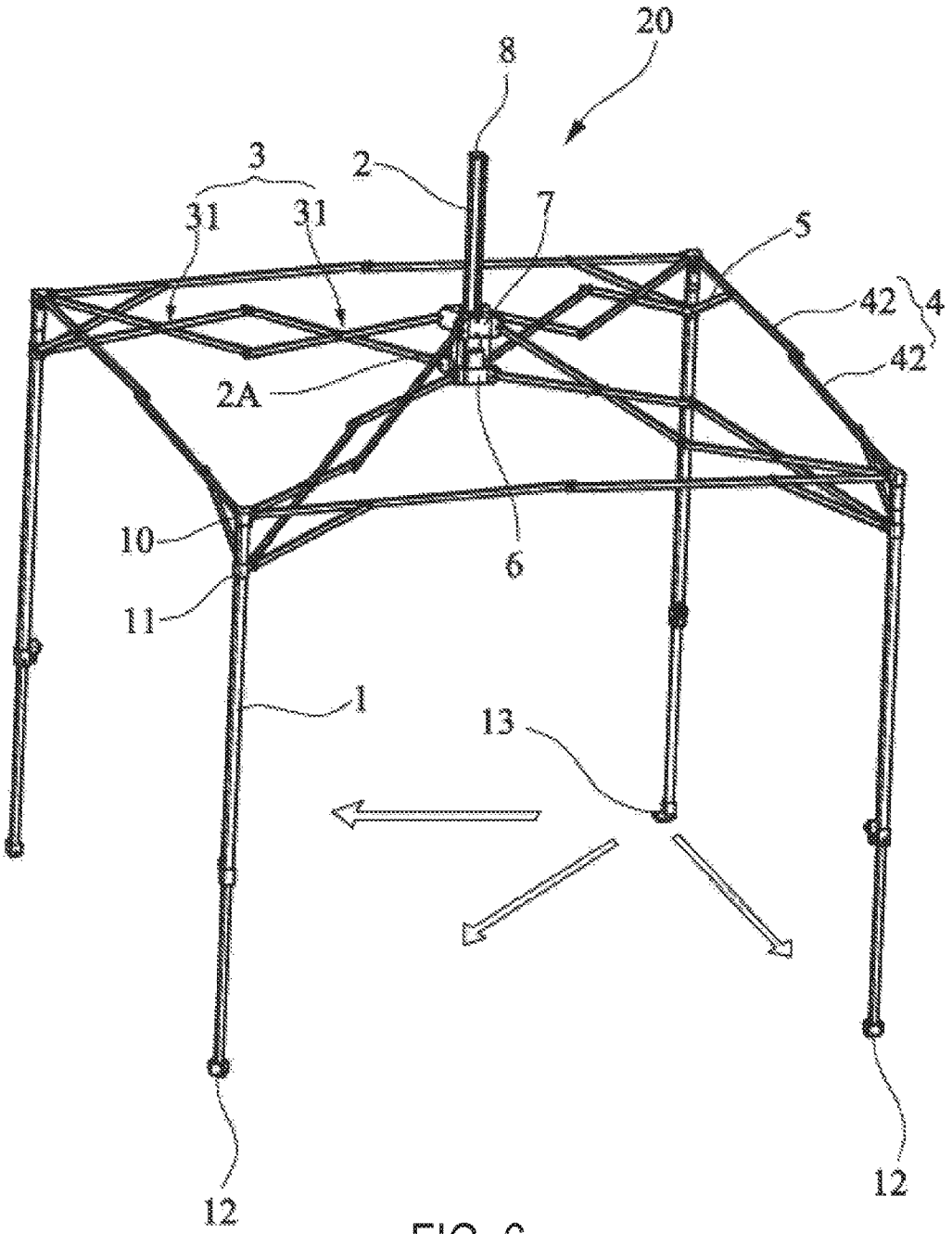
FIG. 6 is a schematic view illustrating a first exemplary variation of the tent frame of FIG. 1 in an unfolded state in accordance with exemplary embodiments of the present invention.

In some embodiments such as the one illustrated in FIG. 6, side connecting unit 4 includes two or more side poles such as side poles 42 pivotally connected to each other at their corresponding ends. Of each side connecting unit, side pole 42 at both ends (e.g., proximal to supporting poles) are pivotally connected to fourth connectors 10 that are fixedly coupled with the two adjacent supporting poles. In some embodiments, upper frame 20 further includes a plurality of oblique poles such as oblique pole 5, each pivotally connected to third connector 11 at a corresponding supporting pole, and pivotally connected to side pole 42 that is connected to fourth connector 11 at the corresponding supporting pole.

Figure 7:
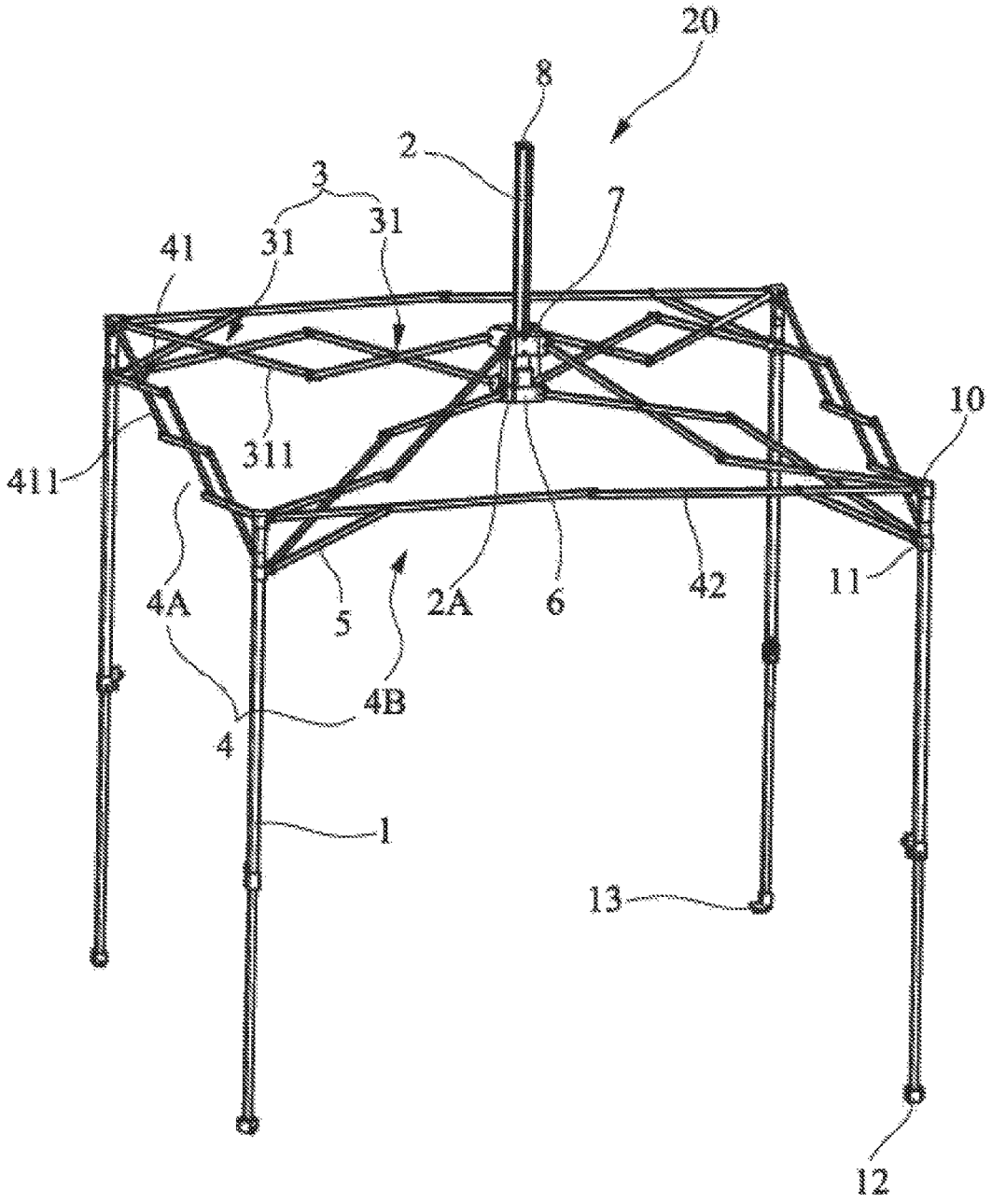
FIG. 7 is a schematic view illustrating a second exemplary variation of the tent frame of FIG. 1 in an unfolded state in accordance with exemplary embodiments of the present invention.

In some embodiments, upper frame 20 includes a plurality of side connecting units, where at least one side connecting unit is different than another side connecting unit. As an example, FIG. 7 illustrates upper frame 20 including two side connecting units 4A disposed at left and right sides of the tent frame and two side connecting units 4B disposed at front and back sides of the tent frame. In the illustrated embodiment, each side connecting unit 4A is made of three side pole pairs 41, and each side connecting unit 4B is made of two side poles 42. As disclosed herein, each side pole pair 41 includes two side poles 411 pivotally connected to each other and forming an "X" shape when unfolded. Adjacent side pole pairs are pivotally connected to each other at their corresponding ends. Of each side connecting unit 4, side poles 411 at both ends are pivotally connected to third connector 11 and fourth connector 10 at adjacent supporting poles. Adjacent side poles 42 are pivotally connected to each other at their corresponding ends, and side poles 42 at both ends of each side connecting unit 4B are pivotally connected to fourth connectors 10 that are fixedly coupled with the two adjacent supporting poles. Corresponding to each side connecting unit 4B, in some embodiments, the tent frame further includes two oblique pole 5. Each oblique pole 5 is pivotally connected to third connector 11 at a corresponding supporting pole, and pivotally connected to side pole 42 that is connected to fourth connector 11 at the corresponding supporting pole.

Upper connecting units 3 can be connected to other parts of the tent frame than third connectors 11 and fourth connectors 10 at supporting poles 1 (e.g., not directly connected to the third or fourth connectors). As an example, FIG. 9 illustrates upper frame 20 of a tent frame having a plurality of side connecting units, each made of two side pole pairs 41. Each side pole pair comprises first and second side poles 411 pivotally connected to each other and forming an "X" shape when unfolded. The first side poles of the two side pole pairs are pivotally connected to each other at their proximal ends, defining an upper pivot point such as upper pivot point 41*a*. The dismal ends of the first side poles of the two side pole pairs are pivotally connected to third connectors 11 at the two adjacent supporting poles. Similarly, the second side poles of the two side pole pairs are pivotally connected to each other at their proximal ends, defining a lower pivot point such as lower pivot point 41*b*. Dismal ends of the second side poles of the two side pole pairs are pivotally connected to fourth connectors 10 at the two adjacent supporting poles.

In the embodiment illustrated in FIG. 9, each upper connecting unit 3 includes one upper pole pair with two upper poles 311. One upper pole 311 has one end pivotally connected to second connector 6 and has another end pivotally connected to the corresponding side connecting unit at upper pivot point 41*a*. The other upper pole 311 has one end pivotally connected to first connector 7 and has another end pivotally connected to the corresponding side connecting unit at lower pivot point 41*b*.

It should be noted that each upper connecting unit 3 can have more than one upper pole pairs, for example, two and three upper pairs illustrated in FIGS. 1 and 8. In such embodiments, one upper pole of the upper pole pair proximal guide pole 2 is pivotally connected to first connector 7 and the other upper pole of the upper pole pair proximal guide pole 2 is pivotally connected to second connector 6. One upper pole of the upper pole pair proximal a corresponding side connecting unit is pivotally connected to the corresponding side connecting unit at upper pivot point 41*a*, and the other upper pole of the upper pole pair proximal the corresponding side connecting unit is pivotally connected to the corresponding side connecting unit at the lower pivot point.

Figure 11:
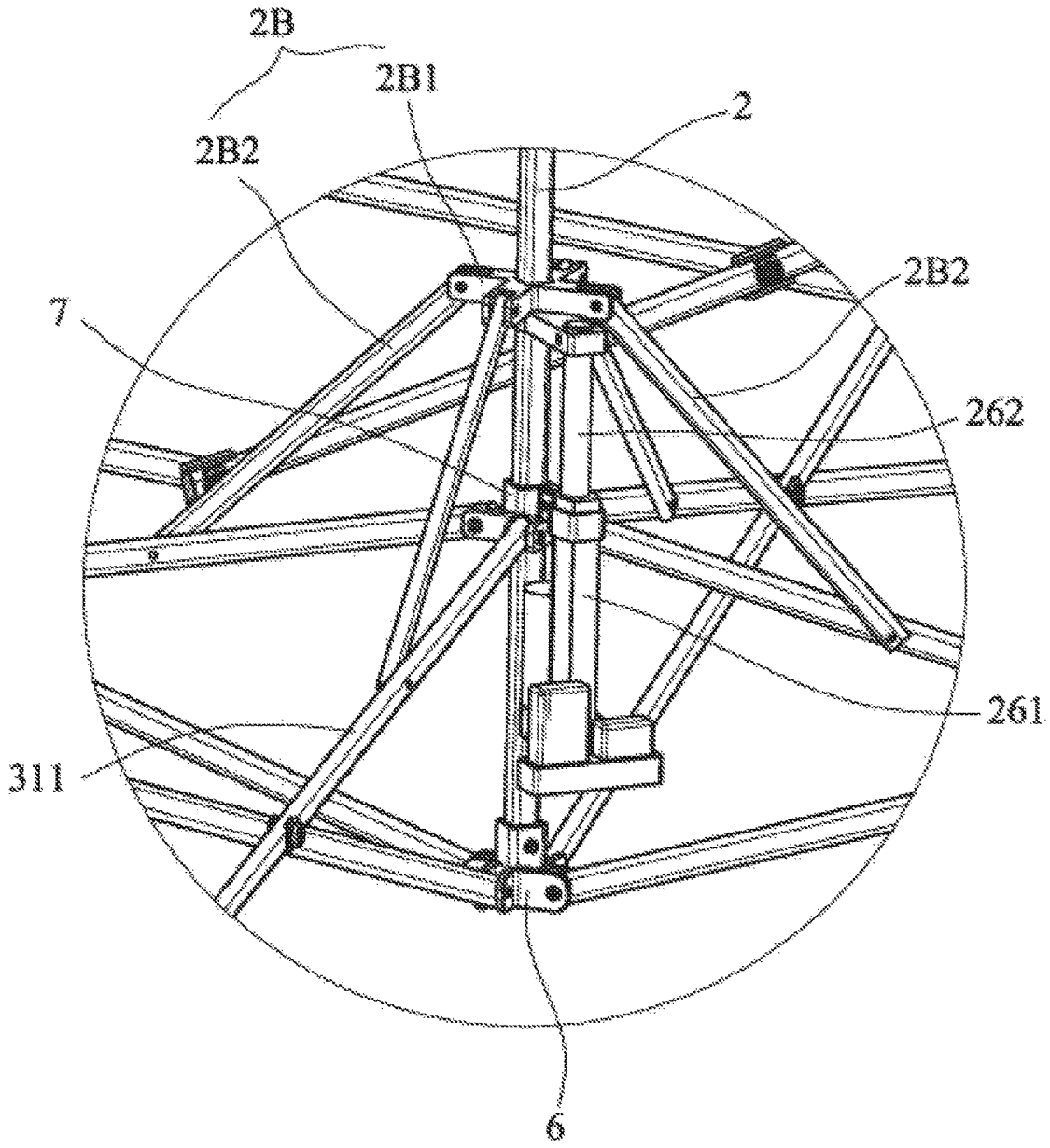
FIG. 11 is a partially enlarged view illustrating the auxiliary mechanism of FIG. 10.
Figure 12:
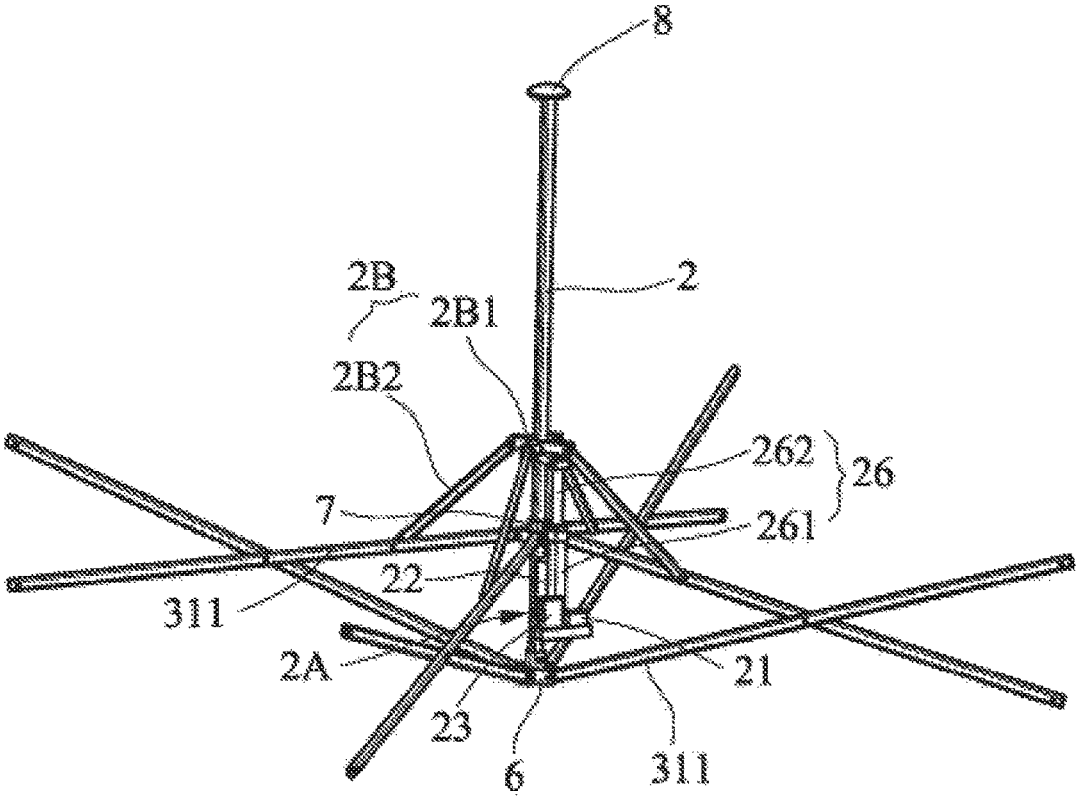
FIG. 12 is a schematic view illustrating a portion of the tent frame of FIG. 10.

Referring to FIGS. 10-12, in some embodiments, a tent frame of the present invention further includes an auxiliary mechanism such as auxiliary mechanism 2B for assisting folding and unfolding of the tent frame. Auxiliary mechanism 2B includes an auxiliary connector such as auxiliary connector 2B1 and a plurality of auxiliary poles such as auxiliary poles 2B2. Auxiliary connector 2B1 is movably disposed on the guide pole above the first connector. Each auxiliary pole 2B2 has one end pivotally connected to the auxiliary connector and the other end pivotally connected to an upper pole that is pivotally connected to the second connector.

In some embodiments, driving mechanism 2A further includes a retractable pole such as retractable pole 26 for further assisting folding and unfolding of the tent frame. Retractable pole 26 has one end connected to motor 22 and the other end connected to auxiliary connector 2B1. In an embodiment, retractable pole 26 includes an outer pole such as outer pole 261 and an inner pole such as inner pole 262 slidably coupled to each other.

Figure 4:
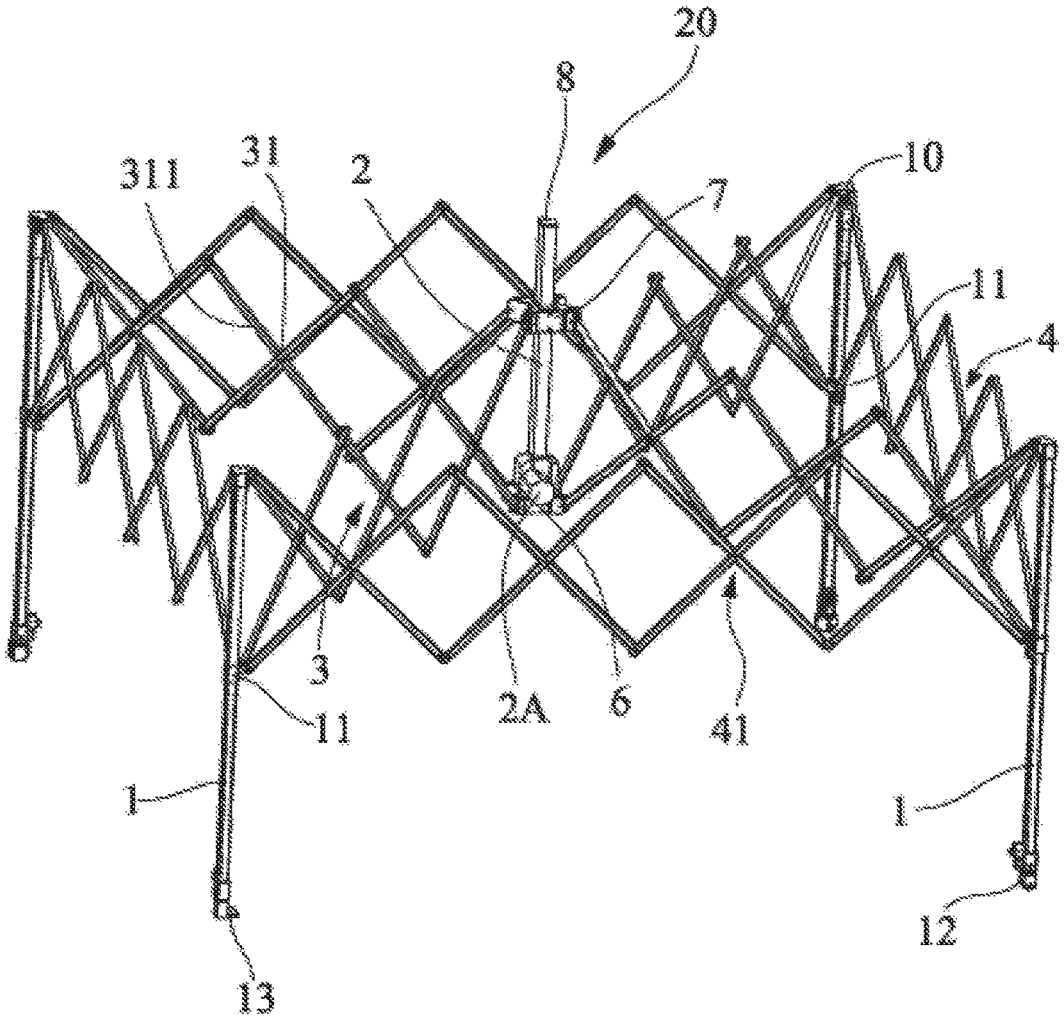
FIG. 4 is a schematic view illustrating the tent frame of FIG. 1 in a state between folded and unfolded states.
Figure 5:
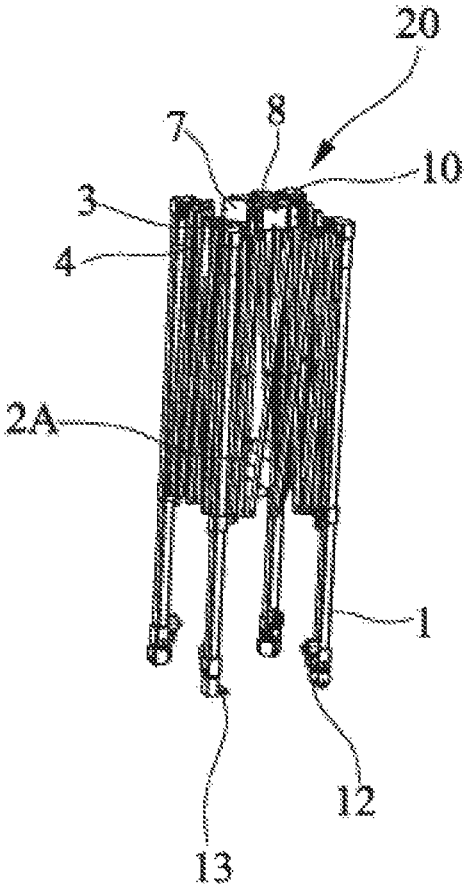
FIG. 5 is a schematic view illustrating the tent frame of FIG. 1 in a folded state.

Referring to FIGS. 1, 4 and 5, to fold a tent frame, press remote control 24 (e.g., pressing a folding button) or turn on controller 21 (e.g., turning on a switch). The controller receives the folding signal from the remote control or is turned on by the switch, and operates motor 22 accordingly. For example, in an embodiment where second connector 6 is fixedly coupled to guide pole 2, the controller operates the motor to move first connector 7 away from second connector 6 (e.g., towards supporting member 8). In another embodiment where both of the first and second connectors are movably coupled to the guide pole, the controller operates the motor to move both of the first and second connectors away from each other. In still another embodiment (such as that illustrated in FIGS. 10-12) with auxiliary mechanism 2B, the controller operates the motor to move auxiliary connector 2B1 away from second connector 6 (e.g., towards supporting member 8) and/or retract inner pole 262 into outer pole 261 to reduce the length of retractable pole 26, resulting in first connector 7 moving away from second connector 6. As the first and/or second connectors move away from each other, upper connecting units 3 contract (e.g., upper poles 311 are folded).

In embodiments (such as those illustrated in FIGS. 1, 6-8 and 10) where upper connecting units 3 are connected to third and fourth connectors installed at supporting poles 1, contraction of upper connecting units 3 pulls supporting poles 1 towards guide pole 2. As the distance between adjacent supporting poles 1 reduces, side connecting units 4 contract (e.g., side poles 411, side pole 42, and/or oblique poles 5 are folded). In embodiments (such as that illustrated in FIG. 9) where upper connecting units 3 are connected to side connecting units 4 at corresponding pivotal points, contraction of upper connecting units 3 pulls and folds side connecting units 4, which in turn pull supporting poles 1 towards guide pole 2. Eventually, the tent frame is folded, and one example is illustrated in FIG. 5.

To unfold a tent frame, press remote control 24 (e.g., pressing an unfolding button) or turn on controller 21 (e.g., turning on a switch). The controller receives the unfolding signal from the remote control or is turned on by the switch, and operates motor 22 accordingly. For example, in an embodiment where second connector 6 is fixedly coupled to guide pole 2, the controller operates the motor to move first connector 7 towards second connector 6. In another embodiment where both of the first and second connectors are movably coupled to the guide pole, the controller operates the motor to move both of the first and second connectors towards each other. In still another embodiment (such as that illustrated in FIGS. 10-12) with auxiliary mechanism 2B, the controller operates the motor to move auxiliary connector 2B1 towards second connector 6 and/or extend inner pole 262 out of outer pole 261 to increase the length of retractable pole 26, resulting in first connector 7 moving toward second connector 6. As such, upper connecting units 3 expand and stretch out.

In embodiments (such as those illustrated in FIGS. 1, 6-8 and 10) where upper connecting units 3 are connected to third and fourth connectors installed at supporting poles 1, expansion of upper connecting units 3 propels supporting poles 1 away from guide pole 2. As the distance between adjacent supporting poles 1 increases, side connecting units 4 expand and stretch out (e.g., side poles 411, side pole 42, and/or oblique poles 5 are unfolded). In embodiments (such as that illustrated in FIG. 9) where upper connecting units 3 are connected to side connecting units 4 at corresponding pivotal points, expansion of upper connecting units 3 propels and unfolds side connecting units 4, which in turn propel supporting poles 1 away from guide pole 2. Eventually, the tent frame is unfolded.

In embodiments with wheels 12 and fixation base 13, contraction and expansion of upper connecting units 3 cause supporting poles with wheels 12 moving towards or away from supporting pole with fixation bass 13. The use of wheels 12 reduces friction between supporting poles and the ground, making the folding and unfolding of the tent frame easier and smoother.

As disclosed herein, a tent frame of the present invention includes a driving mechanism that enables automatic folding and unfolding of the tent frame. The driving mechanism includes a remote control or a switch that can be placed or installed at any easily accessible locations. As such, folding and unfolding of the tent frame is effortless, making it very convenient to use.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that the terms "upper" or "lower", "left" or "right", and etc. are used to describe features of the exemplary embodiments with reference to the positions of such features as displayed in the figures. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. A tent frame comprising:
- a plurality of supporting poles; and
- an upper frame connected to the plurality of supporting poles, and comprising:
  - a guide pole;
  - first and second connectors coupled with the guide pole, wherein at least one of the first and second connectors is movable along the guide pole, and the first connector is above the second connector when the tent frame is unfolded;
  - a plurality of upper connecting units, each comprising one or more upper pole pairs, wherein:
    - each upper pole pair comprises two upper poles pivotally connected to each other and forming an "X" shape when unfolded, and
    - of the upper pole pair proximal the guide pole, one upper pole is pivotally connected to the first connector and the other upper pole is pivotally connected to the second connector;
  - a driving mechanism comprising a motor for moving one or both of the first and second connectors along the guide pole, a power source for providing power to the motor, and a controlling device for controlling the motor; and
  - an auxiliary mechanism for assisting folding and unfolding of the tent frame, the auxiliary mechanism comprising:
    - an auxiliary connector movably disposed on the guide pole above the first connector; and
    - a plurality of auxiliary poles, each having one end pivotally connected to the auxiliary connector and the other end pivotally connected to the one upper pole of the upper pole pair proximal the guide pole that (i) is pivotally connected to the first connector, (ii) is pivotally connected with the other upper pole of the upper pole pair proximal the guide pole, and (iii) forms an "X" shape with the other upper pole of the upper pole pair proximal the guide pole when unfolded.

2. The tent frame of claim 1, wherein the driving mechanism further comprises a retractable pole having one end connected to the motor and the other end connected to the auxiliary connector.

3. The tent frame of claim 1, wherein the guide pole is formed with a rail for guiding the movement of the first or second or both connectors.

4. The tent frame of claim 1, wherein the controlling device comprises a remote control having an emitter, and a controller having a receiver corresponding to the emitter, wherein the controller is operably connected to the motor.

5. The tent frame of claim 1, wherein the controlling device is disposed at one of the supporting poles or at the upper frame.

6. The tent frame of claim 1, wherein the second connector is fixedly coupled to a lower end of the guide pole, wherein the driving mechanism moves the first connected along the guide pole upward to fold the tent frame and downward to unfold the tent frame.

7. The tent frame of claim 1, wherein each upper connecting unit comprises two or three upper pole pairs, and ends of adjacent upper pole pairs in each upper connecting unit are pivotally connected to each other.

8. The tent frame of claim 1, further comprising:
- a plurality of third connectors, each movably coupled with a corresponding supporting pole; and
- a plurality of fourth connectors, each fixedly coupled with an upper end of a corresponding supporting pole,
- wherein of the upper pole pair proximal the corresponding supporting pole, one upper pole is pivotally connected to the third connector and the other upper pole is pivotally connected to the fourth connector.

9. The tent frame of claim 8, wherein the upper frame further comprises a plurality of side connecting units, each disposed between two adjacent supporting poles and comprising two or more side poles pivotally connected to each other at proximal ends thereof, wherein side poles at both ends of each side connecting unit are pivotally connected to the fourth connectors that are fixedly coupled with the two adjacent supporting poles.

10. The tent frame of claim 8, wherein the upper frame further comprises a plurality of side connecting units, each disposed between two adjacent supporting poles and comprising one or more side pole pairs, wherein:
- each side pole pair comprises two side poles pivotally connected to each other and forming an "X" shape when unfolded;
- adjacent side pole pairs are pivotally connected to each other at ends of corresponding side poles; and
- side poles at both ends of the side connecting unit are pivotally connected to the third and fourth connectors at adjacent supporting poles.

11. The tent frame of claim 10, wherein each side connecting unit comprises two, three, or four side pole pairs.

12. The tent frame of claim 1, further comprising:

a fixation base installed at a lower end of a supporting pole in the plurality of the supporting poles; and a plurality of wheels, each installed at a lower end of a remaining supporting pole in the plurality of the supporting poles.

* * * * *